US009024831B2

(12) United States Patent
Wang

(10) Patent No.: US 9,024,831 B2
(45) Date of Patent: May 5, 2015

(54) MINIATURIZED ULTRA-WIDEBAND MULTIFUNCTION ANTENNA VIA MULTI-MODE TRAVELING-WAVES (TW)

(75) Inventor: Johnson J. H. Wang, Marietta, GA (US)

(73) Assignee: Wang-Electro-Opto Corporation, Marietta, GA (US)

( * ) Notice: Subject to any disclaimer, the term of this patent is extended or adjusted under 35 U.S.C. 154(b) by 414 days.

(21) Appl. No.: 13/449,066

(22) Filed: Apr. 17, 2012

(65) Prior Publication Data

US 2012/0299795 A1 Nov. 29, 2012

Related U.S. Application Data

(60) Provisional application No. 61/490,240, filed on May 26, 2011.

(51) Int. Cl.

| | |
|---|---|
| ***H01Q 11/02*** | (2006.01) |
| ***H01Q 1/24*** | (2006.01) |
| ***H01Q 1/32*** | (2006.01) |
| ***H01Q 9/04*** | (2006.01) |
| ***H01Q 9/30*** | (2006.01) |
| ***H01Q 21/28*** | (2006.01) |

(52) U.S. Cl.

CPC ..... *H01Q 1/241* (2013.01); *H01Q 1/3275* (2013.01); *H01Q 9/0407* (2013.01); *H01Q 9/0414* (2013.01); *H01Q 9/30* (2013.01); *H01Q 21/28* (2013.01); *H01Q 5/28* (2015.01); *H01Q 5/342* (2015.01)

(58) Field of Classification Search

USPC ..... 343/700 MS, 702, 737

See application file for complete search history.

(56) References Cited

U.S. PATENT DOCUMENTS

| | | | | |
|---|---|---|---|---|
| 4,835,538 | A * | 5/1989 | McKenna et al. | 343/700 MS |
| 5,121,127 | A * | 6/1992 | Toriyama | 343/700 MS |
| 5,508,710 | A | 4/1996 | Wang | |

(Continued)

OTHER PUBLICATIONS

Wang, J. J. H., V. K. Tripp, J. K. Tillery, and C. B. Chambers, "Conformal multifunction antenna for automobile application," 1994 URSI Radio Science Meeting, Seattle, Washington, p. 224, Jun. 19-24, 1994.

(Continued)

*Primary Examiner* — Hoang V Nguyen
*Assistant Examiner* — Hai Tran
(74) *Attorney, Agent, or Firm* — Thomas | Horstemeyer, LLC

(57) ABSTRACT

A miniaturized ultra-wideband multifunction antenna comprising a conducting ground plane at the base, a plurality of concentric feed cables, one or more omnidirectional one-dimensional (1-D) normal-mode and two-dimensional (2-D) surface-mode traveling-wave (TW) radiators, frequency-selective internal and external couplers, and a unidirectional radiator on top, stacked and cascaded one on top of the other. Configured as a single structure, its unidirectional radiator and plurality of omnidirectional TW radiators can cover, respectively, most satellite and terrestrial communications, with unidirectional and omnidirectional radiation patterns, respectively, needed on various platforms. This new class of multifunction antenna is ultra-wideband, miniaturized and low-cost, thus attractive for applications on automobiles and other small platforms. As a multifunction antenna, a continuous bandwidth up to 1000:1 or more is reachable for terrestrial communications and a continuous bandwidth of 10:1 or more is feasible for satellite communications.

25 Claims, 11 Drawing Sheets

(56) References Cited

U.S. PATENT DOCUMENTS

| | | | | |
|---|---|---|---|---|
| 5,621,422 | A * | 4/1997 | Wang | 343/895 |
| 6,137,453 | A * | 10/2000 | Wang et al. | 343/895 |
| 6,348,897 | B1 | 2/2002 | Gremo et al. | |
| 6,639,558 | B2 * | 10/2003 | Kellerman et al. | 343/700 MS |
| 6,664,932 | B2 | 12/2003 | Frantzis | |
| 6,906,669 | B2 | 6/2005 | Sabet et al. | |
| 7,034,758 | B2 | 4/2006 | Vothknecht et al. | |
| 7,545,335 | B1 * | 6/2009 | Wang | 343/770 |
| 7,839,344 | B2 | 11/2010 | Colasanti et al. | |
| 8,497,808 | B2 * | 7/2013 | Wang | 343/737 |

OTHER PUBLICATIONS

Wang, J. J. H., "Conformal Multifunction Antenna for Automobiles," 2007 International Symposium on Antennas and Propagation (ISAP2007), Niigata, Japan, Aug. 2007.

Wang, J. J. H., "Multifunction Automobile Antennas—Conformal, Thin, with Diversity, and Smart," 2010 International Symposium on Antennas and Propagation (ISAP2010), Macao, China, Nov. 23-26, 2010.

Johnson J. H. Wang, Theory of a Class of Planar Frequency-Independent Omnidirectional Traveling-Wave Antennas, Microwave, Antenna, Propagation and EMC Technologies for Wireless Communications, 2005. MAPE 2005. IEEE International Symposium (vol. 1), 2005.

Johnson J. H. Wang, "Theory of Frequency-Independent antennas as Traveling-Wave Antennas and Their Asymptotic Solution by Method of Stationary Phase," Microwave, Antenna, Propagation and EMC Technologies for Wireless Communications, 2005. MAPE 2005. IEEE International Symposium (vol. 1), 2005.

* cited by examiner

| System | Freq. (MHz) | Polarizatio n | Pattern | Satellite/ Terrestrial |
|---|---|---|---|---|
| AM | 0.526-1.607 | | O | T |
| FM | 87-108 | | O | T |
| Telecom | 137-174 | | O | T |
| Keyless entry | 350 | | O | T |
| Mobile | 450-900 | | O | T |
| GSM/PCS | 900/1900 | | O | T |
| Dig. Aud | 1452-1492 | | O | T |
| DECT | 1900 | | O | T |
| UMTS | 1885-2200 | | O | T |
| UWB | 3100-10600 | | O | T |
| WiMAX | 2400-3500 | | O | T |
| Telematics | 2400-5900 | | O | T |
| GNSS | 1146-1616 | RHCP | UH | S |
| Satellite Radio | 2400-2460 | RHCP | UH | S |
| GEO | 1000-4000 | RHCP | UH | S |

O (Omnidirectional), UH (Unidirectional Hemispherical)

*FIG. 1*

A-A Cross-sectional

180/190/110/120/160

Perspective View

180/190/160

Bottom View

180/190/160

MINIATURIZED ULTRA-WIDEBAND MULTIFUNCTION ANTENNA VIA MULTI-MODE TRAVELING-WAVES (TW)

CROSS-REFERENCE TO RELATED APPLICATION

This application claims priority to copending U.S. provisional application entitled, "Miniaturized Ultra-Wideband Multifunction Antenna Via Multi-Mode Traveling-Waves (TW)," having Ser. No. 61/490,240, filed May 26, 2011, which is entirely incorporated herein by reference.

TECHNICAL FIELD

The present invention is generally related to radio-frequency antennas and, more particularly, multifunction antennas that cover both terrestrial and satellite telecommunications and are conformal for mounting on platforms such as automobiles, personal computers, cell phones, airplanes, etc.

BACKGROUND

The antenna is a centerpiece of any wireless system. With the proliferation of wireless systems, antennas become increasingly numerous and thus difficult to accommodate on any platform of limited surface. An obvious solution is to employ antennas that can handle multiple functions so that fewer antennas are employed on the platform. For example, a major automobile manufacturer has publicly announced its goal to reduce the two dozen antennas on some high-end passenger cars to a single multifunction antenna. For platforms from automobiles to cell phones, such a multifunction antenna must also have sufficiently small size and footprint, low production cost, ruggedness, and aesthetic appeal. For airborne platforms, a multifunction antenna must also have sufficiently small size and footprint and an aerodynamic shape with low profile.

FIG. 1 shows a table that summarizes common wireless systems available for implementation on automobiles, many of which are also available for mobile phones, personal computers, and other small or large platforms on the ground or in the air. This table is by no means complete, as more and more wireless systems are emerging, such as various mobile satellite communications systems, UWB (ultra-wideband) systems, etc. Nor is the table consistent with all the conventions, some of which change with time or vary with geographical locations. Additionally, wireless services are still expanding, so is the need for multifunction antennas.

Such multifunction antennas have been discussed in publications (J. J. H. Wang, V. K. Tripp, J. K. Tillery, and C. B. Chambers, "Conformal multifunction antenna for automobile application," 1994 *URSI Radio Science Meeting*, Seattle, Wash., p. 224, Jun. 19-24, 1994; J. J. H. Wang, "Conformal Multifunction Antenna for Automobiles," 2007 *International Symposium on Antennas and Propagation* (ISAP2007), Niigata, Japan, August 2007; J. J. H. Wang, "Multifunction Automobile Antennas—Conformal, Thin, with Diversity, and Smart," 2010 *International Symposium on Antennas and Propagation* (ISAP2010), Macao, China, Nov. 23-26, 2010) and U.S. Pat. No. (5,508,710, issued in 1996; U.S. Pat. No. 5,621,422, issued in 1997; U.S. Pat. No. 6,348,897, issued in 2002; U.S. Pat. No. 6,664,932, issued in 2003; U.S. Pat. No. 6,906,669 B2, issued in 2005; U.S. Pat. No. 7,034,758 B2, issued 2006; U.S. Pat. No. 7,545,335 B1, issued 2009; U.S. Pat. No. 7,839,344 B2, issued 2010), which are incorporated herein by reference.

Since a multifunction antenna must cover two or more wireless systems, which generally operate at different frequencies, its advances have been marked by ever broader bandwidth coverage. Since the surface area on any platform, especially that ideal or suitable for antenna installation, is limited, a basic thrust for the configuration of multifunction antenna is for shared aperture, size miniaturization, and conformability with the platform on which it is mounted. The multifunction antenna has an inherent cost advantage, as it reduces the number of antennas employed; this advantage can be further enhanced if it is configured to be amenable to low-cost production techniques in industry. In this context two recent U.S. Patent Applications revealed techniques claimed to have these merits (Application No. 61/469,409, filed 30 Mar. 2011; application Ser. No. 13/082,744, filed 11 Apr. 2011), which are incorporated herein by reference. Both Applications are based on the deployment of ultra-wideband low-profile traveling-wave (TW) structures amenable to planar production techniques.

It is noted that the two types of multifunction antennas addressed in these two Patent Applications have different spatial radiation patterns. Antennas in Application No. 61/469,409 radiate a unidirectional hemispherical pattern, while antennas in application Ser. No. 13/082,744 radiate an omnidirectional pattern. This Application discloses a class of multifunction antennas that radiate both unidirectional and omnidirectional patterns needed by some or all satellite and terrestrial services, respectively, as summarized in FIG. 1, by employing a plurality of different TW structures.

In prior art, a technique to reduce the size of a 2-D surface TW antenna is to reduce the phase velocity, thereby reducing the wavelength, of the propagating TW. This leads to a miniaturized slow-wave (SW) antenna (Wang and Tillery, U.S. Pat. No. 6,137,453 issued in 2000, which is incorporated herein by reference), which allows for a reduction in the antenna's diameter and height, with some sacrifice in performance. The SW technique is generally applicable to all TW antennas, those with omnidirectional and unidirectional radiation patterns.

The SW antenna is a sub-class of the TW antenna, in which the TW is a slow-wave with the resulting reduction of phase velocity characterized by a slow-wave factor (SWF). The SWF is defined as the ratio of the phase velocity $V_s$ of the TW to the speed of light c, given by the relationship $$SWF=c/V_s=\lambda_o/\lambda_s \quad (1)$$

where c is the speed of light, $\lambda_o$ is the wavelength in free space, and $\lambda_s$ is the wavelength of the slow-wave at the operating frequency $f_o$. Note that the operating frequency $f_o$ remains the same both in free space and in the slow-wave antenna. The SWF indicates how much the TW antenna is reduced in a relevant linear dimension. For example, an SW antenna with an SWF of 2 means its linear dimension in the plane of SW propagation is reduced to ½ of that of a conventional TW antenna. Note that, for size reduction, it is much more effective to reduce the diameter, rather than the height, since the antenna size is proportional to the square of antenna diameter, but only linearly to the antenna height. Note also that in this disclosure, whenever TW is mentioned, the case of SW is generally included.

With the proliferation of wireless systems, antennas are required to have increasingly broader bandwidth, smaller size/weight/footprint, and platform-conformability, which is difficult to design especially for frequencies UHF and below (i.e., lower than 1 GHz). Additionally, for applications on platforms with limited space and carrying capacity, reductions in volume, weight, and the generally consequential fabrication cost considerably beyond the state of the art are highly desirable and even mandated in some applications. The present class of multifunction antennas discloses techniques to address all these problems.

BRIEF DESCRIPTION OF THE DRAWINGS

FIG. 1 is a table summarizing wireless services available to automobiles.

DETAILED DESCRIPTION OF THE INVENTION DISCLOSURE

This invention discloses a class of ultra-wideband miniaturized multifunction antennas achieved by using multi-mode 3-D (three-dimensional) TW (traveling-wave) structures, wave coupler and decoupler, a dual-mode feeding network, and impedance matching structures, which has greatly reduced size, weight, height, and footprint beyond the state of the art of platform-mounted multifunction antennas by a wide margin.

Figure 2:
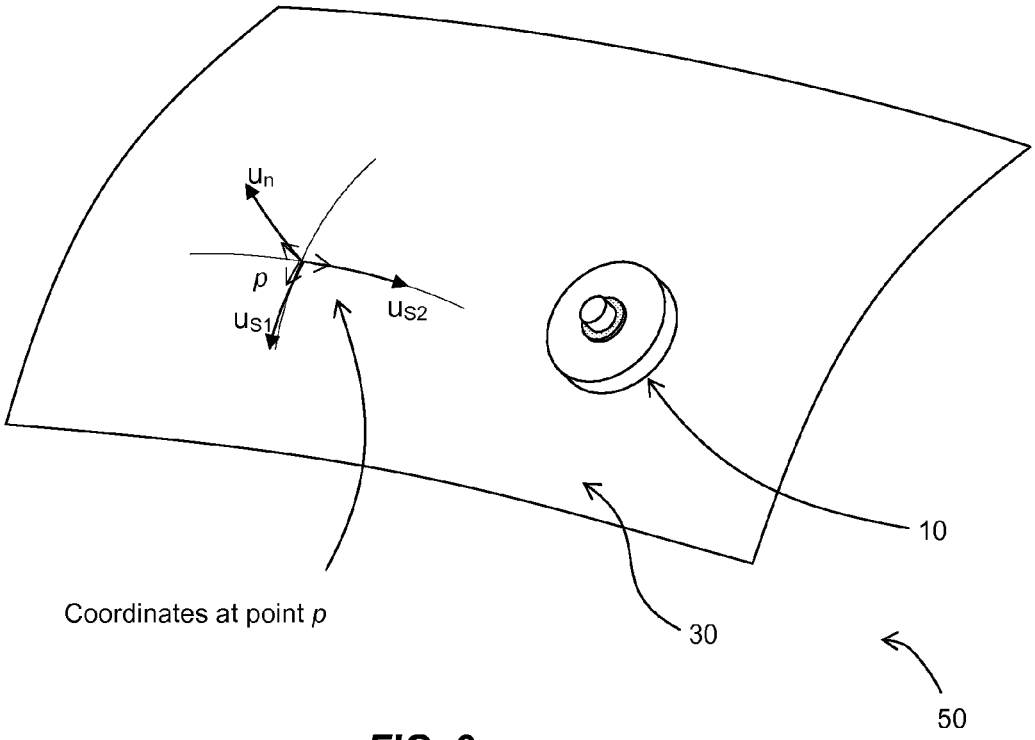
FIG. 2 shows one embodiment of a multifunction antenna mounted on a generally curved surface of a platform.

Referring now to FIG. 2, depicted is a multifunction low-profile 3-D multi-mode TW antenna 10 mounted on the generally curved surface of a platform 30; the antenna/platform assembly is collectively denoted as 50 in recognition of the interaction between the antenna 10 and its mounting platform 30, especially when the dimensions of the antenna are small in wavelength. The antenna is conformally mounted on the surface of a platform, which is generally curvilinear, as depicted by the orthogonal coordinates, and their respective tangential vectors, at a point p. As a practical matter, the antenna is often placed on a relatively flat area on the platform, and does not have to perfectly conform to the platform surface since the TW antenna has its own conducting ground surface. The conducting ground surface is generally chosen to be part of a canonical shape, such as a planar, cylindrical, spherical, or conical shape that is easy and inexpensive to fabricate.

At an arbitrary point p on the surface of the platform, orthogonal curvilinear coordinates $u_{s1}$ and $u_{s2}$ are parallel to the surface, and $u_n$ is perpendicular to the surface. The multifunction multi-mode TW antenna 10 is preferably in the shape of a stack of pillboxes with its center axis oriented parallel to $u_n$ or an axis z (zenith). For description of an antenna's radiation patterns, a plane perpendicular to the axis z and passing through the phase center of the antenna is called an azimuth plane, and a plane containing the z axis and passing through the phase center of the antenna is called an elevation plane. For a field point, its angle about the z axis is called an azimuth angle, and its angle above the elevation plane is called an elevation angle. To be more precise, a spherical coordinate system (r, θ, ϕ) is often used in antenna patterns. A TW propagating in a direction parallel to the surface, that is, perpendicular to $u_n$, is called a surface-mode TW. If the path of a surface-mode TW is along a narrow path, not necessarily linear or straight, the TW is 1-D (1-dimensional). Otherwise the surface-mode TW's path would be 2-D (2-dimensional), propagating radially and preferably evenly from the feed and outwardly along the platform surface.

Figure 3:
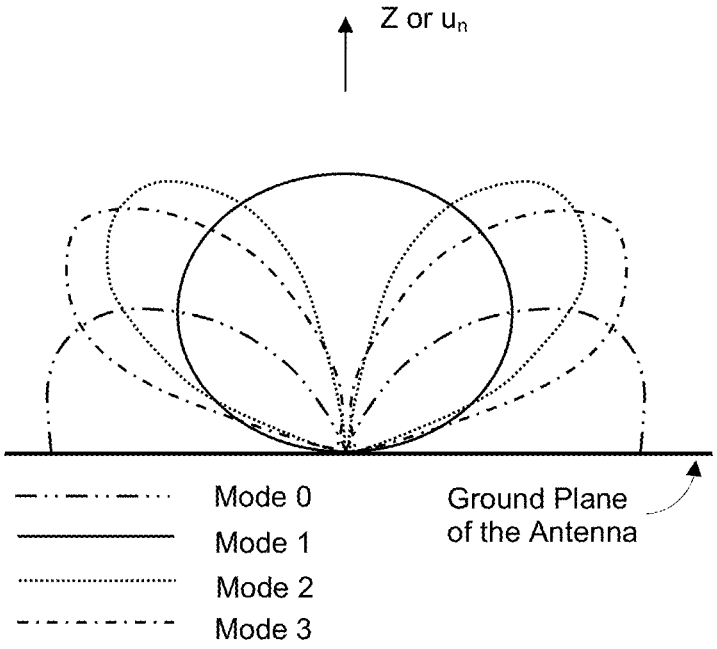
FIG. 3 shows four elevation radiation patterns corresponding to four basic modes in a TW antenna.

Depending on the excitation and the TW structure involved, a 2-D surface-mode TW antenna can radiate one or more of the four elevation radiation patterns as shown in FIG. 3, as discussed in U.S. Pat. No. 5,508,710. In the azimuth plane, which is perpendicular to the zenith axis z, the radiation patterns are all uniform (circular) at any elevation angle above the ground plane. An ideal TW antenna discussed here has an infinite ground plane, thus has no field below the conducting ground plane. In real world the ground plane is finite in extent, therefore there will be side and back lobes. The most commonly employed TW modes are mode-0 (omnidirectional), mode-1 (unidirectional), and mode-2 (tilted omnidirectional).

These TW modes are fundamental to the 2-D TW radiator, as explained below. Without loss of generality, and in view of the reciprocity theorem, we consider only the transmit case. A mode-n TW is launched at the feed point, where a matching structure ensures impedance-matched launch of a desired TW. The desired TW is supported by the TW structure, and radiates away as it propagates outwardly.

The radiated electromagnetic fields can be expressed in terms of wave functions, which are solutions to the scalar wave equation, given by $$\Psi_n = \exp(jn\phi)\int_o^\infty g(k_\rho)J_n(k_\rho\rho)\exp(jk_z z)k_\rho dk_\rho \quad (2)$$

In Eq. (2) a standard cylindrical coordinate system ($\rho,\phi,z$) is employed and the scalar waves are expanded in $\exp(jn\phi)$ and Bessel functions $J_n$ and an arbitrary function $g(k\rho)$ in k-space. The mode-n wave corresponds to the case of n=0, 1, 2, . . . in Eq. (2). The radiation patterns of the basic and useful modes of the TW antenna are mode 0, 1, 2, and 3, as depicted in FIG. 3. This unique multimode feature of this TW antenna is herein exploited to achieve multifunction performance on a single aperture.

Note that the omnidirectional mode-0 TW radiation has a horizontal polarization (which is perpendicular to $u_n$ and the vector connecting the field point and the TW antenna's phase center and which is dependent on the azimuth angle) or a vertical polarization (which is orthogonal to both horizontal polarization and the vector connecting the field and source and which is dependent on the elevation angle). The unidirectional mode-1 and the tilted-omnidirectional mode-2 both have a circular polarization (CP). The sense of the polarization, that is, whether right-hand CP (RHCP) or left-hand CP (LHCP), is determined by the excitation and the TW structure.

While discussions in the present disclosure are carried out in either transmit or receive case, the results and conclusions are valid for both cases on the basis of the theory of reciprocity since the TW antennas discussed here are made of linear passive materials and parts.

Figure 4:
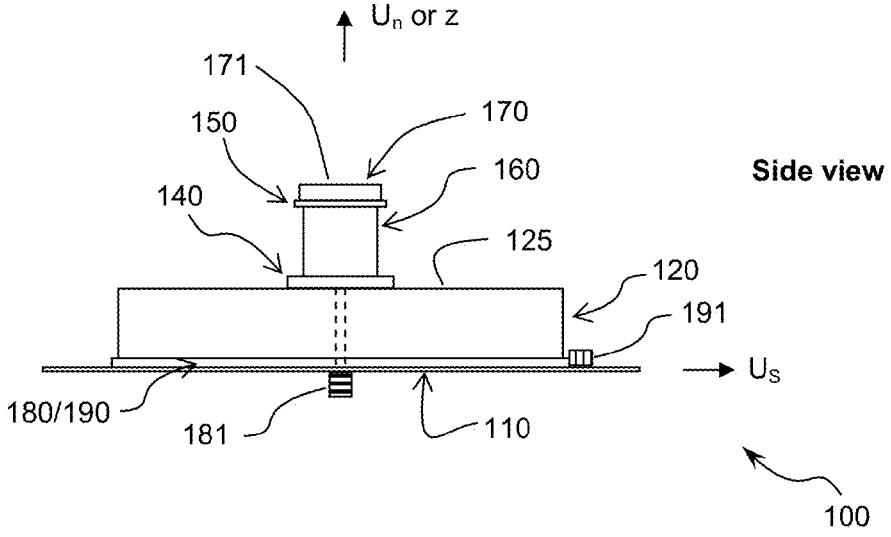
FIG. 4 illustrates one embodiment of an ultra-wideband miniaturized multifunction antenna based on multi-mode 3-D TW.
Figure 4:
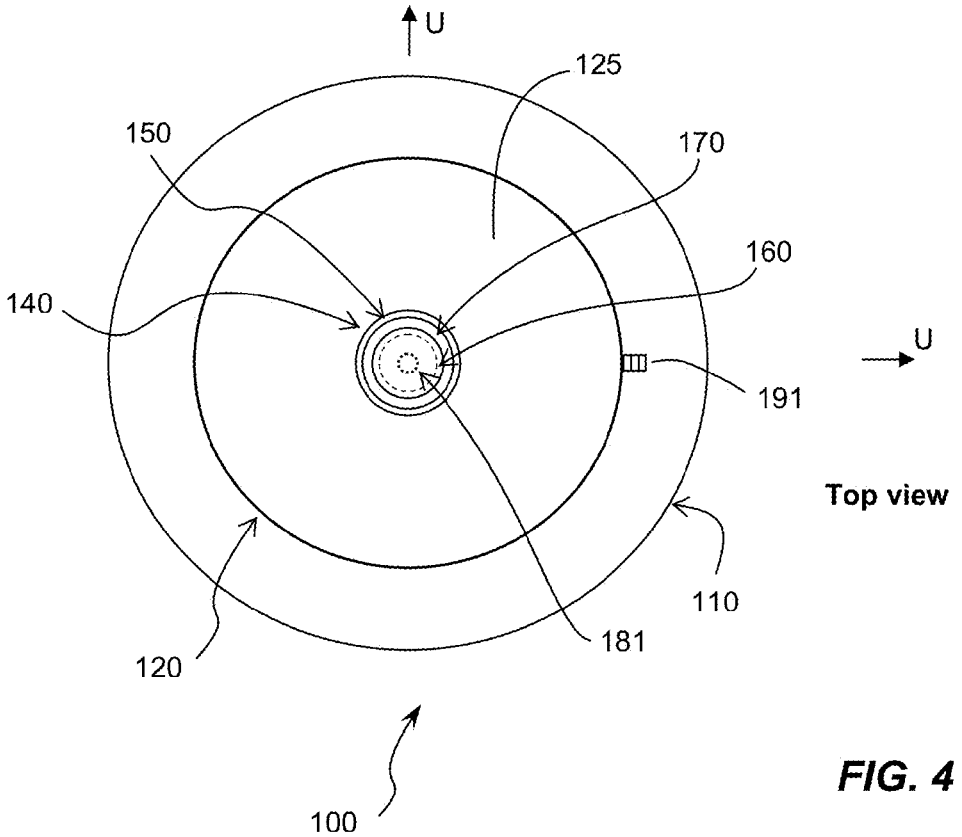
Figure 5A:
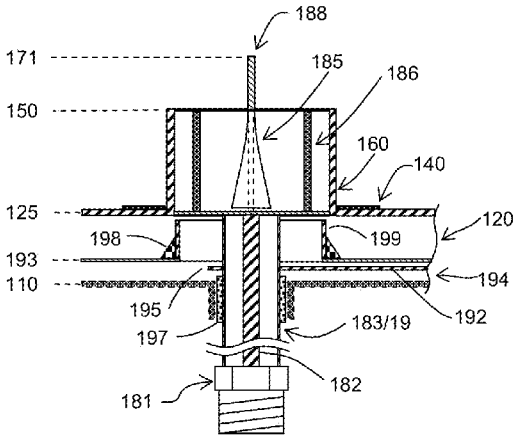
FIG. 5A shows A-A cross-sectional view of the ultra-wideband dual-mode feed network used to feed separately omnidirectional and unidirectional radiators in FIG. 4.
Figure 5B:
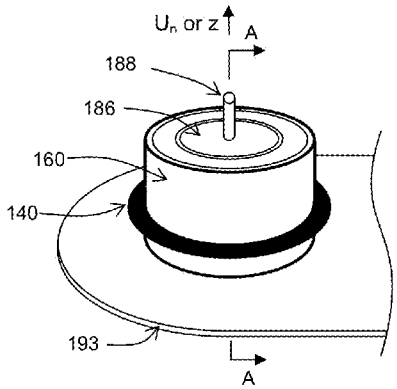
FIG. 5B shows perspective view of the ultra-wideband dual-mode feed network used to feed separately omnidirectional and unidirectional radiators in FIG. 4.
Figure 5C:
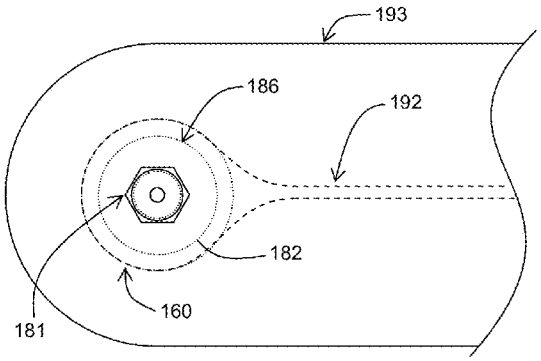
FIG. 5C illustrates bottom view of the ultra-wideband dual-mode feed network used to feed separately omnidirectional and unidirectional radiators in FIG. 4.

As depicted in FIG. 4, in side and top views, one embodiment of this multifunction 3-D multimode TW antenna 100 includes a conducting ground plane 110, a dual-mode feed network consisting of two separate feed networks 180 and 190, a mode-0 (omnidirectional)2-D surface-mode TW structure 120, a frequency-selective external coupler 140, a 1-D normal-mode (omnidirectional) TW structure 160, a frequency-selective external decoupler 150, and a mode-1 (or mode-2 or both) TW structure 170 with a mode-1 (or mode-2 or both) radiator 171, stacked and cascaded, one on top of the other, and structurally integrated as shown in FIGS. 5A-5C. The mode-1 (or mode-2 or both) TW structure 170 handles satellite communications with a unidirectional hemispherical radiation pattern (mode-1), a tilted omnidirectional radiation pattern (mode-2), or a combination of both mode-1 and mode-2. The mode-0 TW structures 120 and 160 together handle terrestrial communications with an omnidirectional radiation pattern.

The mode-1 (or mode-2 or both) TW structure 170 having a mode-1 (or mode-2 or both) radiator 171 is fed by the feed network 180 that has an external connector 181 and passes through the central region of the mode-0 (omnidirectional) 2-D surface-mode TW structure 120, the external coupler 140, the 1-D normal-mode (omnidirectional) TW structure 160, and the external decoupler 150. The mode-0 TW structure 120 is fed in the central region by a feed network 190 that has an external connector 191. The 1-D normal-mode TW structure 160 is excited by mode-0 TW structure 120 via the frequency-selective external coupler 140.

To achieve both omnidirectional and unidirectional hemispherical radiation patterns, each component in FIG. 4 is configured in the shape of a pillbox with a circular or polygonal perimeter and structurally symmetrical about the vertical coordinate $u_n$ or z in order to generate a radiation pattern symmetrical about the $u_n$ axis, even though each component of the 3-D multimode TW antenna 100 is depicted only as a concentric circular form in the top view shown in FIG. 4. All pillbox-shaped components are parallel to the conducting ground plane 110, which can be part of the surface of a canonical shape such as a plane, a cylinder, a sphere, or a cone. Also, the thickness of each TW structure is electrically small, generally less than $0.1\lambda_L$, where $\lambda_L$ denotes the wavelength at the lowest frequency of operation. Additionally, while the preferred 2-D TW structure 120 is symmetrical about a center axis of the antenna, each of the mode-0 2-D surface-mode TW structures can be reconfigured to have an elongated shape in order to conform to certain platforms.

The conducting ground plane 110 is an inherent and innate component, and has dimensions at least as large as those of the bottom of the ultra-wideband low-profile 2-D surface-mode TW structure 120. In one embodiment, the conducting ground plane 110 has a surface area that covers at least the projection on the platform, in the direction of $-u_n$, from the 3-D TW antenna 100 with its conducting ground plane 110 excluded or removed. Since the top surfaces of many platforms are made of conducting metal, they can serve directly as the conducting ground plane 110, if needed. In order to minimize the size of the antenna, the 2-D surface-mode TW structure 120 is generally designed to be less than $\lambda_L/2$ in diameter, where 2 is the wavelength at the lowest frequency of the individual operating band of the 2-D surface-mode TW structure 120 by itself. The individual operating band of the 2-D surface-mode TW structure 120 alone may achieve an octaval bandwidth of 10:1 or more by using, for example, a mode-0 SMM (Spiral-Mode Microstrip) antenna. The 1-D normal-mode TW structure 160 supports a TW propagating along the vertical coordinate $u_n$; its function is to extend the lower bound of the individual operating frequencies of the 2-D surface-mode TW structure 120. In one embodiment, the TW structure 160 is a small conducting cylinder with an optimized diameter and height.

The 2-D surface-mode TW radiator 125, as part of the 2-D surface-mode TW structure 120, may be a planar multi-arm self-complementary Archimedean spiral excited in mode-0 (in which the equivalent current source at any specific radial distance from the vertical coordinate $u_n$ is substantially equal in amplitude and phase and of $\phi$0 polarization in a spherical coordinate system ($r,\theta,\phi$) corresponding to a rectangular coordinate system (x,y,z) with $u_n$ being the z axis as well), specialized to adapt to the application. In other embodiments, the 2-D surface-mode TW radiator 125 is configured to be a different planar structure, preferably self-complementary, as will be discussed in more details later, and excited in mode-0. It is worth noting that the TW radiator 125 is preferably open at the outer rim of the 2-D surface-mode TW structure 120, serving as an additional annular slot that contributes to omnidirectional radiation.

The frequency-selective external coupler 140 is a thin planar conducting structure, which is placed at the interface between the 2-D surface-mode TW structure 120 and the 1-D normal-mode TW structure 160 and optimized to facilitate and regulate the coupling between these adjacent TW structures. Throughout the individual frequency band of the 2-D surface-mode TW structure 120 (generally over a bandwidth of a 10:1 ratio or more), the frequency-selective external coupler 140 suppresses the interference of the 1-D normal-mode TW structure 160 with the 2-D surface-mode TW structure 120. On the other hand, the frequency-selective external coupler 140 facilitates the coupling of power, at the lower end of the operating frequency band of the 3-D multimode TW antenna 100, between the 2-D surface-mode TW structure 120 and the 1-D normal-mode TW structure 160. In one embodiment, the external coupler 140 is made of conducting materials and has a dimension large enough to cover the base (bottom) of the 1-D normal-mode TW structure 160. Simultaneously, the external coupler 140 may be optimized to minimize its impact and the impact of the 1-D normal-mode TW structure 160 on the performance of the 2-D surface-mode TW structure 120 throughout the individual operating band of the 2-D surface-mode TW structure 120. In one embodiment, the external coupler 140 is a circular conducting plate with its diameter optimized under the constraints described above and for the specific performance requirements.

The optimization of the 2-D surface-mode TW structure 120 and the frequency-selective external coupler 140 is a tradeoff between the desired electrical performance and the physical and cost parameters for practical considerations of the specific application. In particular, while ultra-wide bandwidth and low profile may be desirable features for antennas, in many applications the 2-D TW antenna's diameter, and its size proportional to the square of its diameter, become objectionably large, especially at frequencies UHF and below (i.e., lower than 1 GHz). For example, at frequencies below 1 GHz the wavelength is over 30 cm, and an antenna diameter of $\lambda_L/3$ may be over 10 cm; an antenna larger in diameter would generally be viewed negatively by users. Thus, for applications on platforms with limited space and carrying capacity, miniaturization and weight reduction are desirable. In one embodiment, from the perspective of antenna miniaturization, size reduction by a factor of 3 to 5 may be achieved by reducing the diameter of the 2-D surface-mode TW structure 120 while maintaining its coverage at lower frequencies by using the 1-D normal-mode TW structure 160. From the perspective of broadbanding, the 10:1 octaval bandwidth of the simple 2-D TW antenna is broadened to 14:1 or more at a small increase in volume and weight when the 1-D normal-mode TW structure 160 is added, making it a 3-D TW design. Alternatively, a size and cost reduction by a factor of 3 to 6 can be achieved, when compared with a 2-D TW antenna with a corresponding low frequency limit. This cost savings is the consequence of size reduction, which leads to savings in materials and fabrication costs. Cost and size are especially important considerations at frequencies UHF and lower, where antennas would be bulky.

The mode-1 (or mode-2 or both) 2-D TW structure 170 is positioned on top of, and decoupled from, the 1-D normal-mode TW structure 160, and is preferably a mode-1 TW structure as described in U.S. Patent Application No. 61/469,409. The mode-1 2-D TW structure 170 is at least $\lambda_L/\pi$ in diameter, where $\lambda_L$ is the wavelength at the lowest frequency of its operating band. The 2-D TW structure 170 can also be a mode-2 TW structure, which may be more desirable for certain satellite services that orbiting in trajectories at angles of more than 20 degrees off zenith, that is, off coordinate axis $u_n$ or z. However, a mode-2 2-D TW radiator requires a diameter over $2\lambda_L/\pi$, which is double that of a mode-1 TW radiator. The decoupler 150 can be as simple as a conducting ground plane of the mode-1 2-D TW structure 170.

The antenna's feed networks 180 and 190 have their individual output connectors 181 and 191, respectively, and their integration into the antenna 100 is depicted in FIGS. 5A, 5B, and 5C, in cross-sectional, perspective, and bottom views, respectively. As can be seen, FIGS. 5A, 5B, and 5C illustrate succinctly the complex and interweaving structural relationships between the dual-cable feed networks 180 and 190 and the immediate structures in the antenna 100. Feeding the mode-1 radiator is the inner cable (of the dual-cable) having an inner conductor 182 and an outer conductor 183. Feeding the mode-0 radiator is the outer cable (of the dual-cable) with inner conductor 196 and outer conductor 199. The inner and outer cables share a common circular cylindrical conducting shell over a section of 183 and 196. The inner cable 182/183 is connected with a hybrid circuit 185 in an enclosed conducting pillbox 186. The hybrid circuit 185 can be as simple as a balun suitable for mode-1, mode-2 or mode-1-plus-2 excitation of a multi-arm radiator 171, which is connected with a balun or a hybrid circuit 185 by conducting lines 188.

The feed networks 180 and 190 also share a common pillbox space between the two conducting ground planes 110 and 193, a region which contains an enclosed microstrip circuit 194 that leads to the output connector 191 for connection with transceivers that provide terrestrial services commonly requiring an omnidirectional radiation pattern. The enclosed microstrip circuit 194 comprises a microstrip line 192, a conducting ground plane 193, and is inside a conducting pillbox enclosed by conducting ground planes 110 and 193 and vertical conducting walls parallel to axis $u_n$ or z. These conducting walls, which are not explicitly displayed, do not have to be solid, and can be arrays of conducting pins or plated via holes, which may be less expensive to fabricate.

The feed networks 180 and 190 accommodate each other in a manner somewhat similar to that of the dual-band dual-feed cable assembly in U.S. patent application Ser. No. 13/082,744. For example, the outer conductor 183 of the mode-1/mode-2 feed network 180 extending beyond its junction with the microstrip line 192 toward the coaxial connector 181 is a reactance, rather than a potential short circuit to the ground plane 110 since, from the perspective of the mode-0 microstrip line feed 190, the ground plane of the mode-0 microstrip line feed is 193, and the conducting plane 110 is spaced apart from the microstrip line. Higher-order-mode suppressors in the form of conducting walls, and conducting shorting pins and via holes, can be placed to suppress undesired resonances and leakages. Additionally, a thin cylindrical shell 197 made of a low-loss dielectric material can be placed between conducting cylindrical shell 183/196, which is the inner conductor of the mode-0 coaxial cable section of feed network 190, and the extended sleeve of the conducting ground plane 110 to form a capacitive shielding between them. The thin cylindrical dielectric shell 197 removes direct electric contact between the inner conductor 196 of the mode-0 feed cable and the conducting ground plane 110 at the via hole, and is also thin and small enough to suppress any residual power leakage at the frequencies of operation of the lower mode-0 antenna. A small length for the cylindrical dielectric shell 197, as well as the sleeve for conducting ground plane 110 at the via hole, further improve the quality of electric shielding of the mode-0 feed network 190 in this enclosed and shared region. If needed, the entire mode-0 microstrip feed can be encased in solid conducting walls to improve the integrity of the microstrip section of the feed line 190. Finally, a choke can also be placed below 197 to reduce any residual leakage at the via hole, if needed. The transition between the microstrip circuit 194 and the coaxial cable between concentric conducting shells 196 and 199 is impedance matched by the planar matching structure 195 around conducting shell 196.

These two individual feed connectors can be combined into a single connector by using a combiner or multiplexer. The combination can be performed, for example, by first transforming the coaxial connector 181 and the microstrip connector 191 into a circuit in a printed circuit board (PCB), such as a stripline or microstrip circuit. The combiner/multiplexer, placed between the antenna feed and the transmitter/receiver, can be enclosed within conducting walls to suppress and constrain higher-order modes inside the combiner/multiplexer.

The integration of the feed networks 180 and 190 into the multifunction TW antenna 100 is illustrated in its A-A cross-sectional view in FIG. 5A, which specifies the locations on the feed cable assembly that connect with, position at, or interface with, layers 171, 150, 125, 193, and 110, respectively. The feed network 190 feeds the mode-0 2-D surface-mode TW structure 120 by exciting the desired mode-0 TW in the surface-mode radiator 125. Additionally, the antenna feed network 190 matches, on one side, the impedance of the TW structure 120 with an impedance matching structure 198 outside the outer conducting shell 199 and, on the other side, the impedance looking toward the external connector 191, which is typically 50 ohms by itself.

The theory and techniques for the impedance matching structure for broadband impedance matching well established in the field of microwave circuits can be adapted to the present application. It must be pointed out that the requirement of impedance matching must be met for each mode of TW. For instance, impedance matching must be met for each mode if there are two or more modes that are to be employed for multimode, multifunction, or pattern/polarization diversity operations by the antenna.

While the mode-0 2-D TW radiator 125 takes the form of a planar multi-arm self-complementary Archimedean spiral in one embodiment as discussed, it is in general an array of slots which generate omnidirectional radiation patterns, having substantially constant resistance and minimal reactance over an ultra-wide bandwidth, typically up to 10:1 or more in octaval bandwidths. (A planar multi-arm self-complementary spiral, Archimedean or equiangular, is one embodiment of an array of concentric annular slots.) The radiation at the mode-0 TW radiator 125 in mode-0 TW is from the concentric arrays of slots, which are equivalent to concentric arrays of annular slots, magnetic loops, or vertical electric monopoles. The radiation takes place at a circular radiation zone about a normal axis $u_n$ at the center of the mode-0 2-D TW radiator 125, as well as at the edge of the radiator 125.

Figure 6:
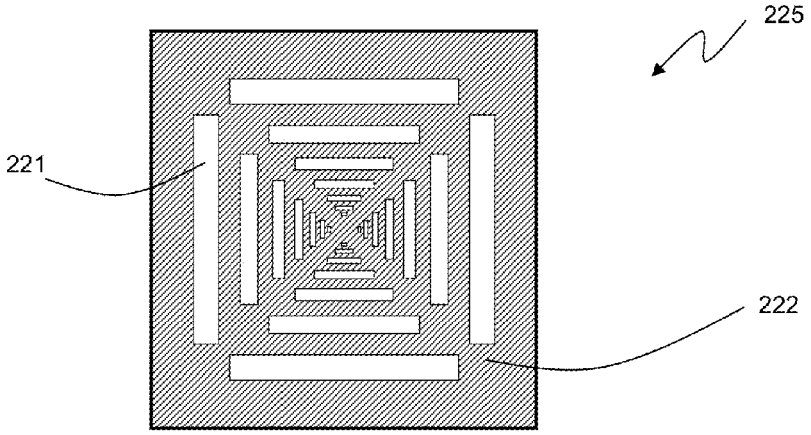
FIG. 6 shows one embodiment of a planar broadband array of slots as another mode-0 omnidirectional TW radiator.
Figure 7A:
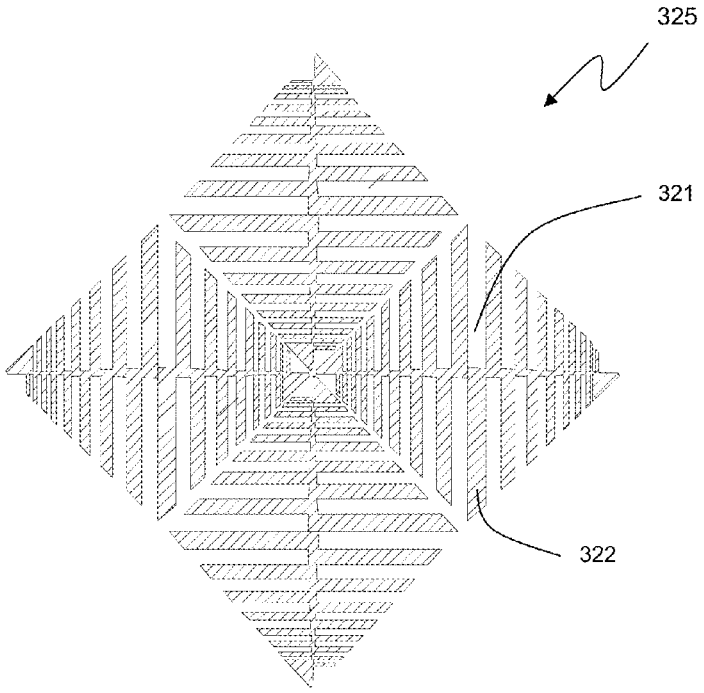
FIG. 7A shows one embodiment of a square planar log-periodic array of slots as another omnidirectional TW radiator.
Figure 7B:
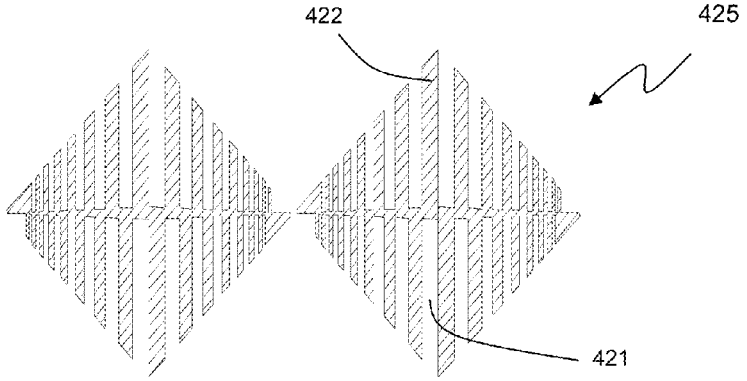
FIG. 7B shows one embodiment of an elongated planar log-periodic structure as another omnidirectional TW radiator.
Figure 8A:
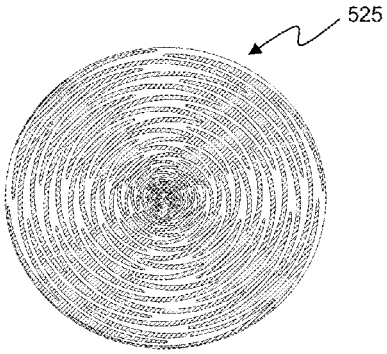
FIG. 8A shows one embodiment of a circular planar sinuous structure as another omnidirectional TW radiator.
Figure 8B:
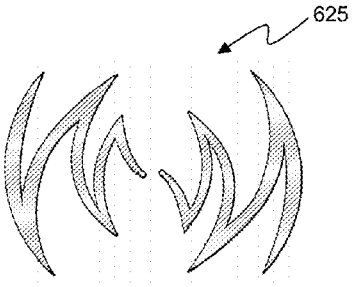
FIG. 8B shows one embodiment of a zigzag planar structure as another omnidirectional TW radiator.
Figure 8C:
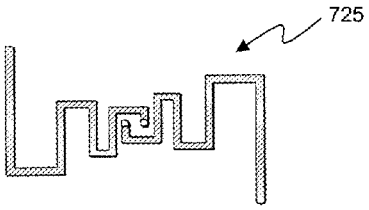
FIG. 8C shows one embodiment of an elongated planar log-periodic structure as another omnidirectional TW radiator.
Figure 8D:
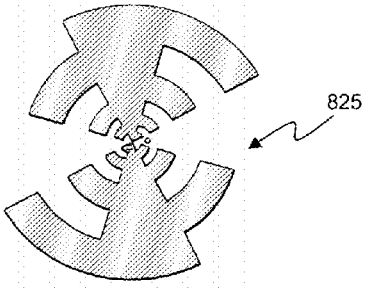
FIG. 8D shows one embodiment of a planar log-periodic self-complementary structure as another omnidirectional TW radiator.

FIG. 6 shows another embodiment of a planar mode-0 2-D TW radiator 225, which may be preferred in certain applications over the planar multi-arm self-complementary spiral as a TW radiator 125. It consists of an array of slots 221, which is an array of concentric subarrays of slots; each subarray of four slots is equivalent to an annular slot. The hatched region 222 is a conducting surface that supports the slots. FIGS. 7A-7B and 8A-8D show additional embodiments of the 2-D TW radiators 125. FIG. 7A shows a 2-D TW radiator 325 having an array of slots 321 and a conducting surface 332 as the hatched region. Additionally, FIG. 7B shows a 2-D TW radiator 425 having an array of slots 421 and a conducting surface 422 as the hatched region. In addition, FIGS. 8A-8D show additional embodiments of the 2-D TW radiators 525, 625, 725, and 825, respectively. While most of the 2-D TW radiator 125, and thus the TW structure 120, are symmetrical about a center axis of the antenna, they can be reconfigured to have an elongated shape in order to conform to certain platforms. These configurations provide additional diversity to the 2-D surface-mode TW radiator 125 capable of ultra-wide bandwidth and other unique features desired in certain applications.

The 2-D TW radiator 171 is structurally similar to those of the mode-0 2-D TW radiator 125, 225, 325, and 525, etc. except in the feed region, where the plurality of arms or slots are fed appropriately, as discussed earlier, for mode-1 or mode-2 or both. A combination of mode-1 and mode-2 with proper phasing and amplitudes can achieve a tilted unidirectional hemispherical pattern, for which a specialized beam or active beam steering can be achieved by replacing the center conductor 182 with two or more feed lines, with a matching hybrid circuit 185, and a plurality of lines 188 to feed a TW radiator 171.

An alternate embodiment of the multifunction antenna 100 is to employ a radiator 170 of any other design, such as the patch antenna, the helical antenna, or the quadrifilar helix antenna, etc, that has a unidirectional pattern like that of the mode-1 (or mode-2 or both) TW antenna. These other types of radiators for 170 do not have the wide bandwidth of the TW radiators, but may be suitable for certain satellite communications as long as they have a sufficiently small footprint or base diameter for mounting on the top of the terrestrial radiator 160 and are electromagnetically compatible with the terrestrial communications systems with the help of an adequate external decoupler 150.

Ultra-Wideband Multifunction TW Antenna with Dual 2-D Mode-0 TW Radiators

Figure 9A:
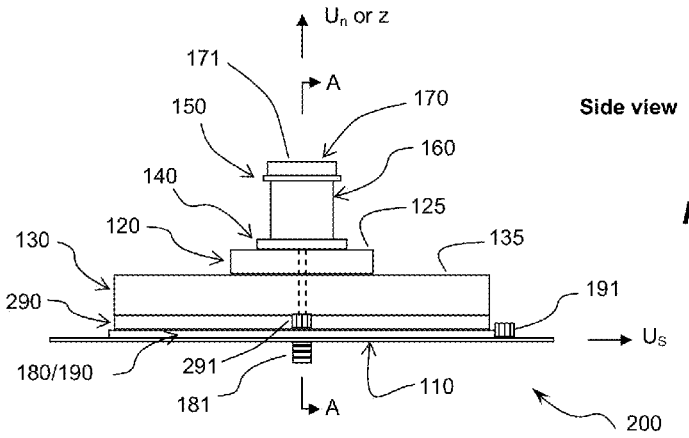
FIG. 9A shows side view of one embodiment of a multifunction antenna with unidirectional radiator and dual omnidirectional radiators.
Figure 9B:
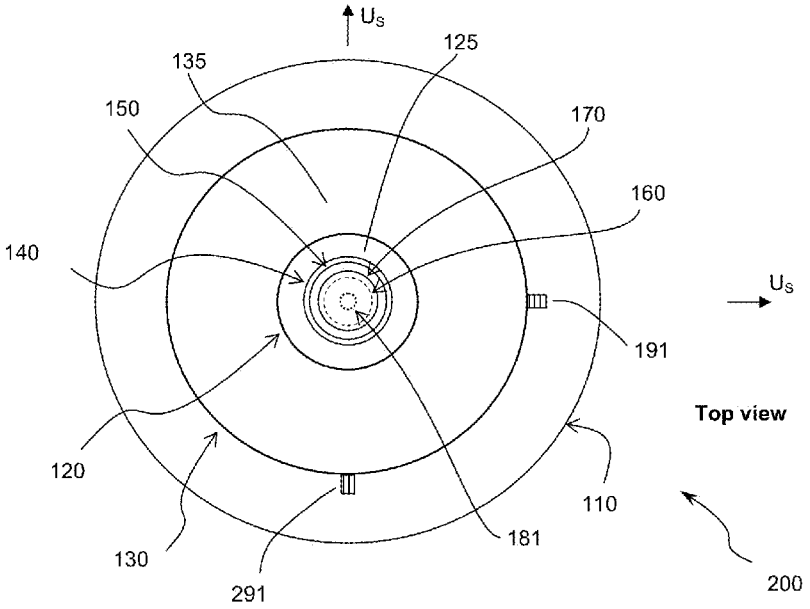
FIG. 9B shows top view of the multifunction antenna of FIG. 9A with unidirectional radiator and dual omnidirectional radiators.
Figure 9C:
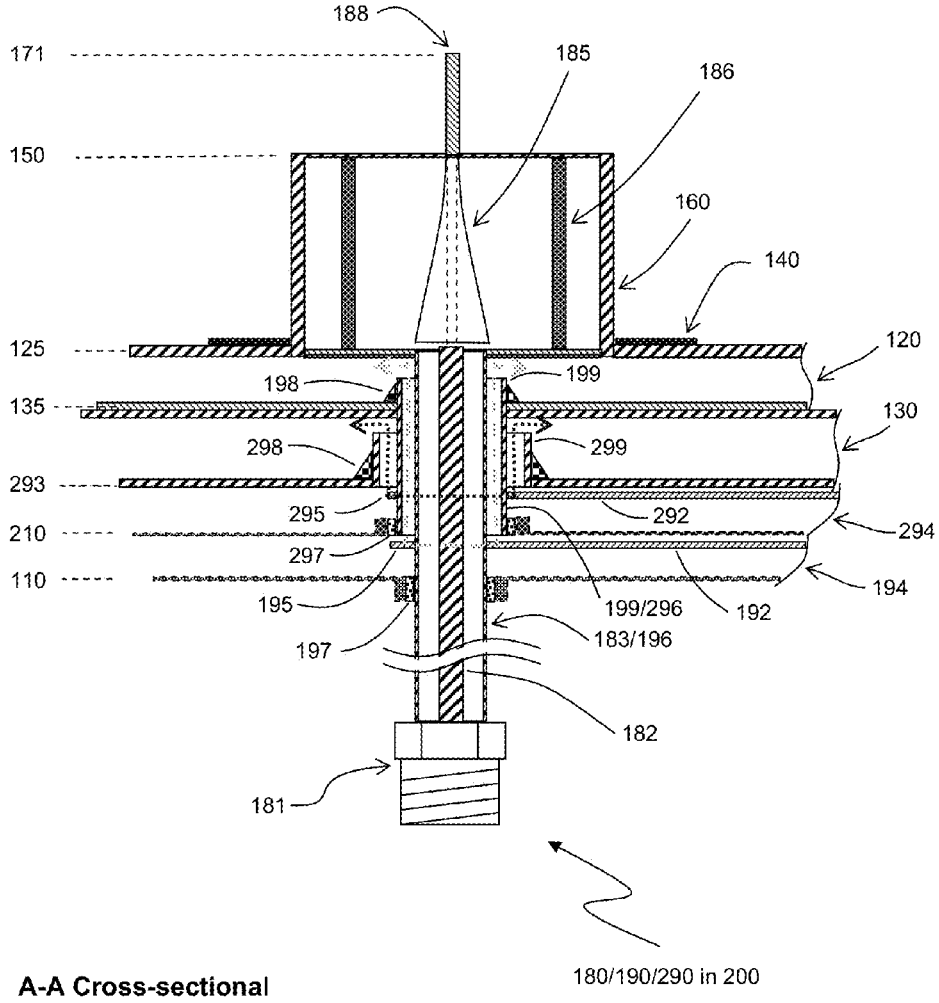
FIG. 9C illustrates A-A cross-sectional view of the multifunction antenna of FIG. 9A with unidirectional radiator and dual omnidirectional radiators.

FIGS. 9A and 9B show, in side view and top view, respectively, another embodiment of a multifunction antenna 200 for terrestrial communications with a bandwidth considerably broader than that of antenna 100, achieved by having dual 2-D mode-0 TW radiators. The basic approach is to insert, in antenna 100, a 2-D surface-mode TW structure 130 below TW structure 120 to cover a frequency range with a median frequency lower than that of 120; thus TW structure 130 is physically larger in diameter than 120. FIG. 9C shows an exploded cross-sectional view of the feed network assembly 180, 190, and 290. As can be seen, an additional feed network 290, which contains an enclosed microstrip circuit 294 and an output connector 291 for connection with transceivers that provide terrestrial services, is also added to feed TW structure 130.

Thus the multifunction antenna 200 has two 2-D surface-mode TW structures, 120 and 130, with supporting feed networks 190 and 290 which contain microstrip circuits 194 and 294, respectively. As shown in FIG. 9C, the flows of electromagnetic waves in these two terrestrial communications channels through feed networks 190 and 290 are depicted by dashed and dotted lines of different colors (or of different grades of shade in black-and-white display), for TW structures 120 and 130, respectively, in the direction of the arrows for the transmit case, without loss of generality in light of reciprocity theory.

In other words, the multifunction antenna 200 achieves an ultra-wide bandwidth for terrestrial communications by having two cascaded 2-D surface-mode TW structures 120 and 130 which are fed by two feed networks 190 and 290 with corresponding external connectors 191 and 291, respectively. The cable section of the three feed networks 180, 190 and 290 accommodate one another structurally as an assembly of concentric conducting cylindrical shells in a manner somewhat similar to that between the feed networks 180 and 190 as discussed earlier for multifunction antenna 100 in this application as well as that in U.S. patent application Ser. No. 13/082,744 for the dual-band dual-feed cable assembly. On the side of the radiators, the three concentric cables are peeled off one by one, sequentially, to feed the satellite service (unidirectional) radiator 171 at the top and the two 2-D terrestrial communications (omnidirectional) radiators 125 and 135 below. The most inner cable, which is a coaxial cable section of feed network 180, has an inner conductor 182 and an outer conducting shell 183. The median cable, which is a coaxial cable section of feed network 190, has an inner conductor 196 (which structurally is also 183 of feed network 180) and an outer conducting shell 199. The outer cable, which is a coaxial cable section of feed network 290, has an inner conductor 296 (which structurally is also 199 of feed network 190) and an outer conducting shell 299.

On the side of the transceivers, the external connector 181 is connected with the satellite service radiator 171 directly via a coaxial cable with inner conductor 182 and outer conductor 183, while external connectors 191 and 291 are connected with terrestrial communications (omnidirectional) radiators 125 and 135 through feed networks 190 and 290, respectively The feed networks 190 and 290 begin with external connectors 191 and 291, connected directly or via cables respectively with microstrip circuits 194 and 294, which have microstrips 192 and 292 and respective conducting ground planes 210 and 293. Both microstrip circuits are enclosed by conducting walls parallel and perpendicular with the z axis.

Similar to that in antenna 100, the outer conductor 183 of the feed network 180 extending beyond its junction with the microstrip line 190 toward the coaxial connector 181 is a reactance, rather than a potential short circuit to the ground plane 110 since, from the perspective of the microstrip circuit 194, the ground plane of the microstrip circuit is 210, and the conducting plane 110 is spaced apart from the microstrip line. Suppression of higher-order modes and their leakages and resonances can be achieved by techniques described for feed network 190 earlier. Additionally, a thin cylindrical shell 197 made of a low-loss dielectric material can be placed between conducting cylindrical shell 183/196, which is the inner conductor of the coaxial cable section of feed network 190, and the extended sleeve of the conducting ground plane 110 to form a capacitive shielding between them. The thin cylindrical dielectric shell 197 removes direct electric contact between the inner conductor 196 of the feed cable section of feed network 190 and the conducting ground plane 110 at the via hole, and is also thin and small enough to suppress any power leakage at frequencies of feed network 190. A small length for the cylindrical dielectric shell 197, as well as the sleeve for conducting ground plane 110 at the via hole, further improve the quality of electric shielding of the feed network 190 in this enclosed and shared region. The entire microstrip feed is preferably encased in solid conducting walls to improve the integrity of the microstrip section of the feed line 190. Finally, a choke can also be placed below 197 to reduce any leakage at the via hole, if needed.

Similarly, the outer conductor 296 of the mode-0 feed network 290 extending beyond its junction with the microstrip line 292 toward the coaxial connector 181 is a reactance, rather than a potential short circuit to the ground plane 210 since, from the perspective of the mode-0 microstrip line feed 290, the ground plane of the mode-0 microstrip line feed is 293, and the conducting plane 210 is spaced apart from the microstrip line. Nevertheless, a thin cylindrical shell 297 made of a low-loss dielectric material can be placed between conducting cylindrical shell 296, which is the inner conductor of the mode-0 coaxial cable section of feed network 290, and the extended sleeve of the conducting ground plane 210 to form a capacitive shielding between them. The thin cylindrical dielectric shell 297 removes direct electric contact between the inner conductor 296 of the feed cable section of feed network 290 and the conducting ground plane 210 at the via hole, and is also thin and small enough to suppress any power leakage at frequencies of feed network 290. A small length for the cylindrical dielectric shell 297, as well as the sleeve for conducting ground plane 210 at the via hole, further improve the quality of electric shielding of the feed network 290 in this enclosed and shared region. The entire microstrip feed is preferably encased in solid conducting walls to improve the integrity of 294, the microstrip section of the feed network 290. Finally, a choke can also be placed below 297 to reduce any leakage at the via hole, if needed.

The transition between the microstrip circuit 194 and the coaxial cable between concentric conducting shells 196 and 199 is impedance matched by the planar matching structure 195 around conducting shell 196. The transition between the microstrip circuit 294 and the coaxial cable between concentric conducting shells 296 and 299 is impedance matched by a planar matching structure 295 around conducting shell 296.

These individual feed connectors can be combined into a single connector by using a combiner or multiplexer, if needed. The combination can be performed, for example, by first transforming two or more of the external connectors 181, 191, and 291 into a circuit in a printed circuit board (PCB), such as a microstrip line or a stripline circuit. The combiner/multiplexer, placed between the antenna feed and the transmitter/receiver, can be enclosed within conducting walls, as well as shorting pins and conducting via holes, to suppress and constrain higher-order modes inside the combiner/multiplexer.

The integration of the feed networks 180, 190, and 290 into the multifunction TW antenna 200 is also illustrated in its A-A cross-sectional view in FIG. 9C, which specifies the locations on the feed cable assembly that connect with, position at, or interface with, layers 171, 150, 125, 135, 293, 210 and 110, respectively. The feed network 190 feeds the mode-0 2-D surface-mode TW structure 120 by exciting the desired mode-0 TW in the surface-mode radiator 125. Additionally, the antenna feed network 190 matches, on one side, the impedance of the TW structure 120 with an impedance matching structure 198 outside the outer conducting shell 199 and, on the other side, the impedance looking toward the external connector 191, which is typically 50 ohms by itself. Similarly, the antenna feed network 290 matches, on one side, the impedance of the TW structure 130 with an impedance matching structure 298 outside the outer conducting shell 299 and, on the other side, the impedance looking toward the external connector 291, which is typically 50 ohms by itself.

Ultra-Wideband Multifunction TW Antennas with Multiple Multi-Mode TW Radiators

An embodiment for a multifunction antenna is to expand the feed network 180 in FIGS. 9A, 9B, and 9C by replacing the center conductor 182 with one or more transmission lines (such as a plurality of coaxial cables and/or twin-lead lines), with all the components structurally integrated, which should enable more complex radiation characteristics, including complex radiation patterns (from a mode-1-plus-mode-2 null-steering TW antenna to even a beam-steering phased array) as well as a variety of signal processing functions for radiator 171 of TW structure 170. Indeed, radiator 171 can be any transmit or receive aperture (or both) with such a feed network 180.

Another embodiment for a multifunction antenna is to add more 2-D surface-mode mode-0 omnidirectional TW structures, in a manner similar to the addition of 130 and its supporting feed network 290 in FIGS. 9A, 9B, and 9C, thus further broadening the bandwidth of mode-0 omnidirectional coverage by a decade. As a result, one can expect to broaden the bandwidth of mode-0 omnidirectional coverage to 1000:1 by adding one more 2-D surface-mode mode-0 omnidirectional TW structures in cascade, and to 10000:1 by adding another one.

Ultra-Wideband Multifunction TW Antennas with at Least One Section of Nonconcentric Cable Assembly The multifunction antennas can have at least one section of their cable assembly being not of the concentric type described in this invention, generally below the unidirectional antenna that is located at the top. The nonconcentric part of the cable feed line can be arranged to cause only a small disturbance to the omnidirectional pattern at one narrow azimuthal angular region, which would cause only a small degradation in diversity gain in the multipath terrestrial propagation environment. For example, in the multifunction antenna of FIG. 4, feed cable 181 can be that for the omnidirectional radiator 125, and the feed cable for the unidirectional antenna 170 at the top can directly run through the 1-D normal-mode TW structure 160 and then radially outwardly along, and to the rim of, the omnidirectional radiator 125, where the cable comes down to the ground plane for connection with the transceiver.

Many variations and modifications may be made to the above-described embodiments of the invention without departing substantially from the spirit and principles of the invention. All such modifications and variations are intended to be included herein within the scope of the present invention.

Experimental Verification

Figure 10A:
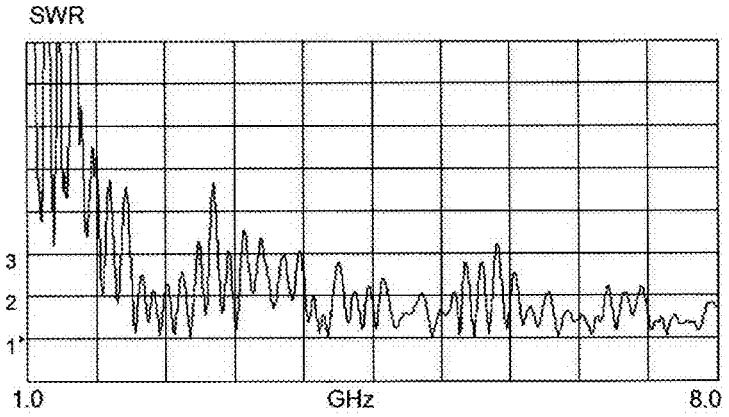
FIG. 10A shows measured VSWR for the antenna in FIG. 9A-9C from the mode-1 satellite services terminals over 1.0-8.0 GHz.

Experimental verification of each of the fundamental principles of the invention has been carried out satisfactorily with breadboard models. For the omnidirectional radiators, a continuous octaval bandwidth of 100:1, over 0.2-20.0 GHz, has been demonstrated as has been documented in USPTO application Ser. No. 13/082,744, filed 11 Apr. 2011. The unidirectional TW structure and its radiator in the breadboard model is a mode-1 slow-wave antenna of 5-cm diameter, which has a size reduction of 40% from a regular 2-D surface-mode TW antenna. FIG. 10A shows measured VSWR of this antenna at satellite service frequencies over 1-8 GHz. As an early model, the performance is fair; there is considerable potential for further improvement by optimizing the impedance match.

Figure 10B:
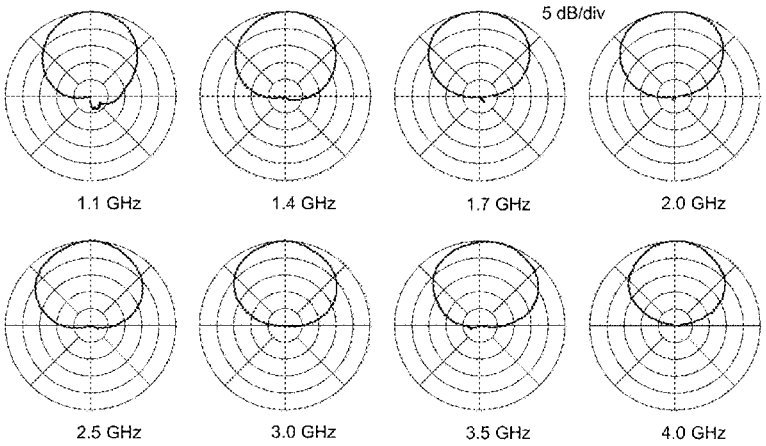
FIG. 10B shows typical measured radiation patterns of the antenna in FIG. 9A-9C from the mode-1 satellite services terminals over 1.1-4.0 GHz.

FIG. 10B shows its typical measured elevation radiation patterns of RHCP over 1-4 GHz, the frequencies of interest for most satellite services for automobiles. As can be seen, these radiation patterns are in a fairly desirable unidirectional hemispherical shape needed for satellite communications, including GPS, GLONASS, Galileo, and Compass, which are collectively known as GNSS (Global Navigation Satellite System), and satellite radio systems, etc. Additional data for pattern and gain over 1-4 GHz and at higher frequencies are promising, especially in light of the diversity of feed network arrangements that are available by implementing more complex transmission lines for 182 of feed network 180.

Observation on the measured data, not shown here, indicates that a bandwidth much wider is also feasible. These data also indicate, though indirectly, that the combination of two surface-mode TW radiators and a normal-mode TW radiator can lead to a continuous octaval bandwidth of 140:1 or more. Analyses of the measured data indicate that continuous bandwidth up to 1000:1 or more is reachable for terrestrial communications by cascading more omnidirectional TW structures, and that a continuous bandwidth of 10:1 or more, with a hemispherical unidirectional pattern needed for satellite communications, is feasible.

The invention claimed is:

1. A multifunction antenna comprising:

a unidirectional radiator, a plurality of traveling-wave (TW) structures comprising stacked ultra wideband low-profile two-dimensional (2-D) surface-mode TW structures, wherein the surface-mode TW structure is excited in mode-0 and comprises a 2-D surface-mode TW radiator for omnidirectional radiation, a dual-mode feed network consisting of at least two separate feed networks, and a conducting ground plane;

wherein the plurality of TW structures and feed networks being cascaded in a stack, with the appropriate frequency-selective coupler or decoupler between adjacent radiators;

wherein the 2-D surface-mode TW structures being further configured to have a diameter less than $\lambda_L/2$and a thickness less than $\lambda_L/10$, where $\lambda_L$ is the free-space wavelength at the lowest frequency of operation of the 2-D surface-mode TW structures;

wherein the multi-mode feed network consisting of at least two separate feed networks, one for the unidirectional radiator and one for each mode-0 2-D TW structure; and wherein the conducting ground surface is of a canonical shape, the conducting ground surface further being positioned at a bottom side of the antenna, and having a surface area covering at least the projection of the antenna.

2. The multifunction antenna as claimed in claim 1, wherein the unidirectional radiator is an ultra-wideband low-profile 2-D TW structure.

3. The multifunction antenna as claimed in claim 2, wherein the unidirectional radiator is an ultra-wideband low-profile mode-1 2-D TW structure.

4. The multifunction antenna as claimed in claim 2, wherein the unidirectional radiator is an ultra-wideband low-profile mode-2 2-D TW structure.

5. The multifunction antenna as claimed in claim 2, wherein the unidirectional radiator is an ultra-wideband low-profile 2-D TW structure having both mode-1 and mode-2.

6. The multifunction antenna as claimed in claim 1, wherein at least one of the TW structures is of a slow-wave (SW) type and has a diameter that is less than $\lambda_L/(2\times SWF)$, wherein SWF is a Slow Wave Factor for the 2-D surface-mode TW structure of SW type.

7. The multifunction antenna as claimed in claim 1, wherein the plurality of TW structures comprises an ultra-wideband low-profile 2-D surface-mode TW structure placed above the conducting ground surface and a normal-mode TW structure stacked above the ultra-wideband low-profile 2-D surface-mode TW structure; the normal-mode TW structure being electromagnetically coupled with the surface-mode TVV structure by an external coupler.

8. The multifunction antenna as claimed in claim 1, wherein the plurality of TW structures comprises a low-frequency ultra-wideband low-profile 2-D surface-mode TW structure positioned above the conducting ground surface, a high-frequency ultra-wideband low-profile 2-D surface-mode TW structure positioned above the low-frequency ultra-wideband low-profile 2-D surface-mode. TW structure, and wherein the feed network comprises a coaxial cable feeding the unidirectional radiator and a dual-connector dual-band coaxial cable ensemble which feeds the low-frequency ultra-wideband low-profile 2-D surface-mode TW structure and the high-frequency ultra-wideband low-profile 2-D surface-mode TW structure.

9. The multifunction antenna as claimed in claim 8, further comprising a normal-mode TW structure being positioned above the high-frequency 2-D surface-mode TW structure and below the unidirectional radiator, and wherein a frequency-selective external coupler is placed between the normal-mode TW structure and the high-frequency surface-mode TW structure to facilitate electromagnetic coupling.

10. The multifunction antenna as claimed in claim 1, wherein the plurality of TW structures further comprises:

a low-frequency ultra-wideband low-profile 2-D surface-mode TW structure being positioned above the conducting ground surface;

a normal-mode TW structure stacked above the low-frequency ultra-wideband low-profile 2-D surface-mode TW structure;

a high-frequency ultra-wideband low-profile 2-D surface-mode TW structure stacked above the normal-mode TW structure; and wherein a frequency-selective external coupler is placed in between the normal-mode TW structure and each of the two 2-D surface-mode TW structures, and wherein the feed network comprises a dual-connector dual-band coaxial cable ensemble that feeds each of the two 2-D surface-mode TW structures and passes through a center portion of the normal-mode TW structure.

11. The multifunction antenna as claimed in claim 1 or claim 2, wherein at least one of the 2-D TW radiators is a planar multi-arm Archimedean spiral.

12. The multifunction antenna as claimed in claim 1 or claim 2, wherein at least one of the 2-D TW radiators is a planar multi-arm equiangular spiral.

13. The multifunction antenna as claimed in claim 1 or claim 2, wherein at least one of the 2-D TW radiators is a planar zigzag structure.

14. The multifunction antenna as claimed in claim 1 or claim 2, wherein at least one of the 2-D TW radiators is a planar array of slots.

15. The multifunction antenna as claimed in claim 1 or claim 2, wherein at least one of the 2-D TW radiators is a planar self-complementary structure.

16. The multifunction antenna of claim 1 wherein the feed network contains a multi-band multi-mode cable assembly comprising:

an assembly of concentric cables comprising an inner cable and a plurality of outer cables, the inner cable consisting of at least one transmission line in the center and an enclosing cylindrical conductor shell, each outer cable being a coaxial cable sharing a common concentric cylindrical conducting shell with adjacent cables;

wherein each outer cable has a first end and a second end, the first end having a transition structure for connection to a planar radial waveguide, the second end having a transition structure for connection to a planar printed circuit board;

wherein the planar radial waveguides connected with the first end of the outer cables being stacked one above the other, and the planar printed circuit board connected with the second end of the outer cables being stacked one above the other.

17. The multifunction antenna of claim 16, wherein a cylindrical shell made of dielectric material is placed between the outer conducting cylindrical shell of each cable and the conducting ground plane of the adjacent planar printed circuit board to form a capacitive shielding between them.

18. The multi-band multi-mode cable assembly of claim 16, wherein the transmission line in the inner cable is a conducting line.

19. The multi-band multi-mode cable assembly of claim 16, wherein the transmission line in the inner cable has at least one coaxial cable.

20. The multi-band multi-mode cable assembly of claim 16, wherein the multiple transmission lines of the inner cable convey a plurality of electrical signals or transform an electrical signal into a plurality of signals.

21. The multi-band multi-mode cable assemblies of claim 16, 17, 18, 19 or 20, wherein the multi-band multi-mode cable is configured to simultaneously feed one unidirectional antenna and multiple two-dimensional surface-mode traveling wave structures in a cascaded and structurally integrated manner.

22. The multifunction antenna of claim 1, wherein at least one section of the multi-band multi-mode cable assembly below the bottom of the unidirectional antenna is not of the concentric type, but are separate cables integrated into the 1-D normal-mode TW structure and the 2-D surface-mode TW radiator.

23. A multifunction antenna comprising:

a conducting ground plane, at least one two-dimensional (2-D) traveling-wave (TW) structure, at least one frequency-selective external coupler, at least one 1-dimensional (1-D) normal-mode TW structure, at least one unidirectional radiator located at the top of said multifunction antenna, at least one frequency-selective external decoupler, multiple feed networks comprising a multi-band multi-mode cable assembly, stacked, cascaded and structurally integrated;

wherein the 2-D TW structures being further configured to have a diameter less than $\lambda_L/2$and a thickness less than $\lambda_L/10$, where $\lambda_L$ is the free-space wavelength at the lowest frequency of operation of the 2-D surface-mode TW structures.

24. The multifunction antenna as claimed in claim 23, wherein at least one of the 2-D TW structures is of a slow-wave (SW) type and has a diameter that is less than $\lambda_L/(2\times \text{SWF})$, wherein SWF is a Slow Wave Factor for the 2-D surface-mode TW structure of SW type.

25. The multifunction antenna of claim 23, wherein additional 2-D surface-mode TW structures being added using the multi-band multi-mode cable assembly of claims 16, 17, 18, 19 or 20 configured to simultaneously feed one unidirectional antenna and multiple two-dimensional surface-mode TW structures.

* * * * *